US005871205A

United States Patent [19]

Latham

[11] Patent Number: 5,871,205

[45] **Date of Patent: *Feb. 16, 1999**

[54] SIZE ADAPTABLE BOLT TENSIONER

[76] Inventor: Robert J. Latham, 8718 Lupton La., Houston, Tex. 77055

[ * ] Notice: This patent issued on a continued prosecution application filed under 37 CFR 1.53(d), and is subject to the twenty year patent term provisions of 35 U.S.C. 154(a)(2).

[21] Appl. No.: 652,977

[22] Filed: May 24, 1996

[51] Int. Cl.[6] ..... B25B 29/00

[52] U.S. Cl. ..... 254/29 A

[58] Field of Search ..... 254/29 A; 81/57.38; 29/452, 252, 723

[56] References Cited

U.S. PATENT DOCUMENTS 4,012,826 3/1977 Stansfield ..... 254/29 A 4,844,418 7/1989 Cole ..... 81/57.38

5,330,159 7/1994 Heiermann ..... 254/29 A

OTHER PUBLICATIONS

Reflange, Inc., *Reflange Hydraulic Bolt Tensioners Brochure*, Houston, Texas (1994).

*Primary Examiner*—Robert C. Watson

*Attorney, Agent, or Firm*—Arnold White & Durkee

[57] ABSTRACT

An adaptor for a bolt tensioner, including a sleeve having a threaded external surface for engaging a threaded surface on the bolt tensioner, and internal threads on an internal surface of the sleeve for engaging a threaded bolt. The external threads and the internal threads of the sleeve are of different size, such that the bolt tensioner can be adapted to tension bolts of different sizes.

27 Claims, 8 Drawing Sheets

SIZE ADAPTABLE BOLT TENSIONER

TECHNICAL FIELD OF THE INVENTION

This invention relates generally to bolt tensioners used to preload bolts prior to tightening, and more particularly, to a method and apparatus for adapting a bolt tensioner to preload different sizes of bolts.

BACKGROUND OF THE INVENTION

Every bolting application presents a unique set of operating conditions. However, all bolting applications require uniform compression and accurate residual bolt load. This requirement stems from the fact that a major cause of failure in bolted joints is an incorrect preload. While in service, bolts that are improperly preloaded for a specific set of operating conditions may experience cyclic stresses that induce fatigue failures. Correctly preloading a bolt results in improved bolt fatigue life, increased joint rigidity, and the elimination of bolt relaxation, joint separation, and joint slippage. Therefore, proper preloading can eliminate catastrophic failures and increase service life.

To achieve the required preload, an accurate means of determining the tensile force applied to the bolt must be employed. Of the variety of preloading techniques currently in use, torquing, thermal tensioning, and hydraulic tensioning are the most common. Torquing is conventionally used for bolt preloading because of its perceived simplicity and reduced cost. However, the difficulty of quantifying the frictional forces that must be overcome during torquing results in significant deviations (e.g., up to ±30%) from the desired preload. Moreover, torsional stresses introduced during torquing may cause distortion, thread galling, stress cracking, and bolt fatigue. Thermal tensioning (i.e., heating and cooling the bolt to be tensioned) is a complicated procedure that requires special tools and components to achieve a desired preload. Moreover, the method is laborious, time consuming, expensive, and may present a significant safety hazard.

Hydraulic bolt tensioning applies a direct axial load to the bolt to be tensioned. In operation, the hydraulic bolt tensioner is threadably engaged to the bolt, a hydraulic pressure is applied and the bolt is preloaded, the nut is tightened, and the pressure is released. Because hydraulic tensioning eliminates the frictional and torsional forces encountered with torquing, it results in more accurate and consistent bolt preloading. In addition, hydraulic bolt tensioners are generally smaller, lighter, and easier to use than torquing tools. Therefore, their compact design and lightweight enables them to be used in many applications where limited space would prohibit the use of bulky torque wrenches or impact tools. Moreover, hydraulic bolt tensioning does not require heat, hammering, or loud noises.

Referring to FIG. 1A, a conventional fixed-size hydraulic bolt tensioner 10 includes a bridge 15 which rests upon a surface (not shown) through which a bolt 20 to be tensioned passes. A body 25, mounted on top of the bridge 15, receives a piston 30. The piston 30 includes threads 35 which are of the same size as the threads 40 on the bolt 20. The piston 30 and the bolt 20 are threadably engaged in preparation for applying a preload to the bolt 20. The preload is created by a hydraulic pressure source (not shown), which may be connected to the hydraulic bolt tensioner 10 via a threaded pressure coupling 45. The threaded pressure coupling allows a pressure to be applied at the interface 50 between the piston 30 and the body 25. The pressure at the interface 50 is substantially maintained by a pair of seals 55 interposed between the piston 30 and the body 25. The delivery of a pressurized hydraulic fluid to the interface 50 results in relative movement of the piston 30 with respect to the body 25 and the application of an axial load along the center line of the bolt 20. Once a desired preload is achieved, a nut 60 may be tightened (e.g., either by hand or with tools), the pressure released, and the hydraulic bolt tensioner 10 disengaged from the bolt 20.

Where tensioning of different sized bolts is required, a plurality of fixed-size hydraulic bolt tensioners, one for each size bolt to be tensioned, has usually been employed. Alternatively, referring to FIG. 1B, a variable-size hydraulic bolt tensioner 65 has been used. The primary difference between a variable-size and a fixed-size hydraulic bolt tensioner resides in the use of an adaptor 70 with the piston 30 to vary the size of bolt which the hydraulic bolt tensioner may engage. The adaptor 70 includes a threaded internal surface 75 for engaging the threads 40 of a bolt 20 to be tensioned. Because the external surface 80 of the adaptor 70 is smooth, the internal surface 85 of the piston 30 likewise does not include threads (compare FIG. 1A).

Variable-size hydraulic bolt tensioners operate in much the same manner as described above for fixed-size hydraulic bolt tensioners. However, the insertion of the adaptor 70 into the piston 30 requires that the adaptor shoulder 90 bear the reaction force normally borne by the threads of the piston (compare FIG. 1A). The force bearing capability of the adaptor is proportional to the bulk of the adaptor shoulder 90 and the piston wall 95. Because the preloads applied during hydraulic bolt tensioning can be as high as 1,000,000 lbs., the bulk of the adaptor may consume a significant portion of the volume of the central cavity 100 of the piston 30. Therefore, the range of sizes to which a given variable-sized hydraulic bolt tensioner may be adapted is limited. Moreover, the required bulk of the adaptor increases material costs, and therefore the equipment expenses associated with variable-size hydraulic bolt tensioning. In addition, the smooth surface interface of the external surface 80 of the adaptor 70 and the internal surface 85 of the piston 30 may result in the adaptor 70 becoming a high velocity projectile should the bolt 20 or threads 40, 75 fail during tensioning. Such a projectile creates a significant safety hazard to operators of hydraulic bolt tensioners. Moreover, the adapters are only compatible with variable-size hydraulic bolt tensioners and cannot be used to adapt fixed-size hydraulic bolt tensioners to different sized bolts. Therefore, in order to tension bolts of varying size, an operator currently owning fixed-size hydraulic bolt tensioners must choose between purchasing a wide variety of fixed-size hydraulic bolt tensioners or a variable-size hydraulic bolt tensioner with a wide variety of adapters.

SUMMARY OF THE INVENTION

In general, in one aspect, the invention features an adaptor for a bolt tensioner, including a sleeve having a threaded external surface for engaging a threaded surface on the bolt tensioner and internal threads on an internal surface of the sleeve for engaging a threaded bolt. The external threads and the internal threads of the sleeve are of different size, such that the bolt tensioner can be adapted to tension bolts of different sizes.

In general, in another aspect, the invention features a method of adapting a bolt tensioner to a second size bolt, including the steps of providing a sleeve having threaded internal and external surfaces, the threaded internal surface engageable with the second size bolt, and engaging the threaded external surface with a threaded cavity in the tensioner for a first size bolt.

In general, in another aspect, the invention features a bolt tensioner, including a body comprising a base and a piston, the body and piston moveable relative to one another in response to a force supplied therebetween, the piston having a threaded receptacle for engaging a first size bolt, and an adaptor having internal threads for engaging a second size bolt, the adaptor having external threads for engaging the threaded receptacle.

In general, in another aspect, the invention features a method of tensioning bolts, including the steps of inserting an external adaptor into a bolt tensioner having a threaded receptacle, the adaptor having threads for engaging the threaded receptacle and internal threads for engaging a bolt, engaging the adaptor and the bolt, and tensioning the bolt.

BRIEF DESCRIPTION OF THE DRAWINGS

Other objects and advantages of the invention will become apparent upon reading the following detailed description and upon reference to the drawings in which.

DESCRIPTION OF THE PREFERRED EMBODIMENT

Figure 1A:
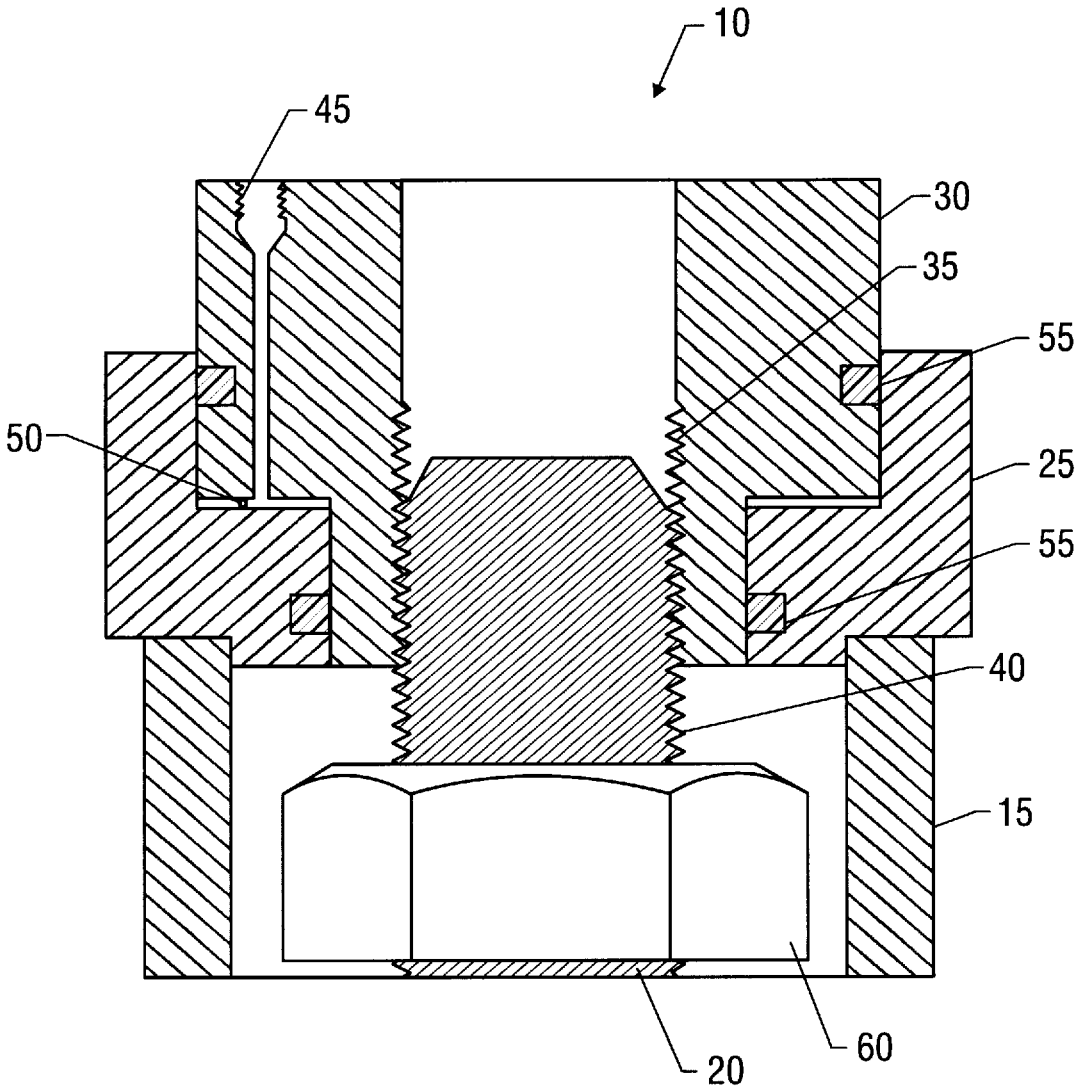
FIG. 1A (prior art)
FIGS. 1A and 1B illustrate sectional views of prior art hydraulic bolt tensioners.
Figure 1B:
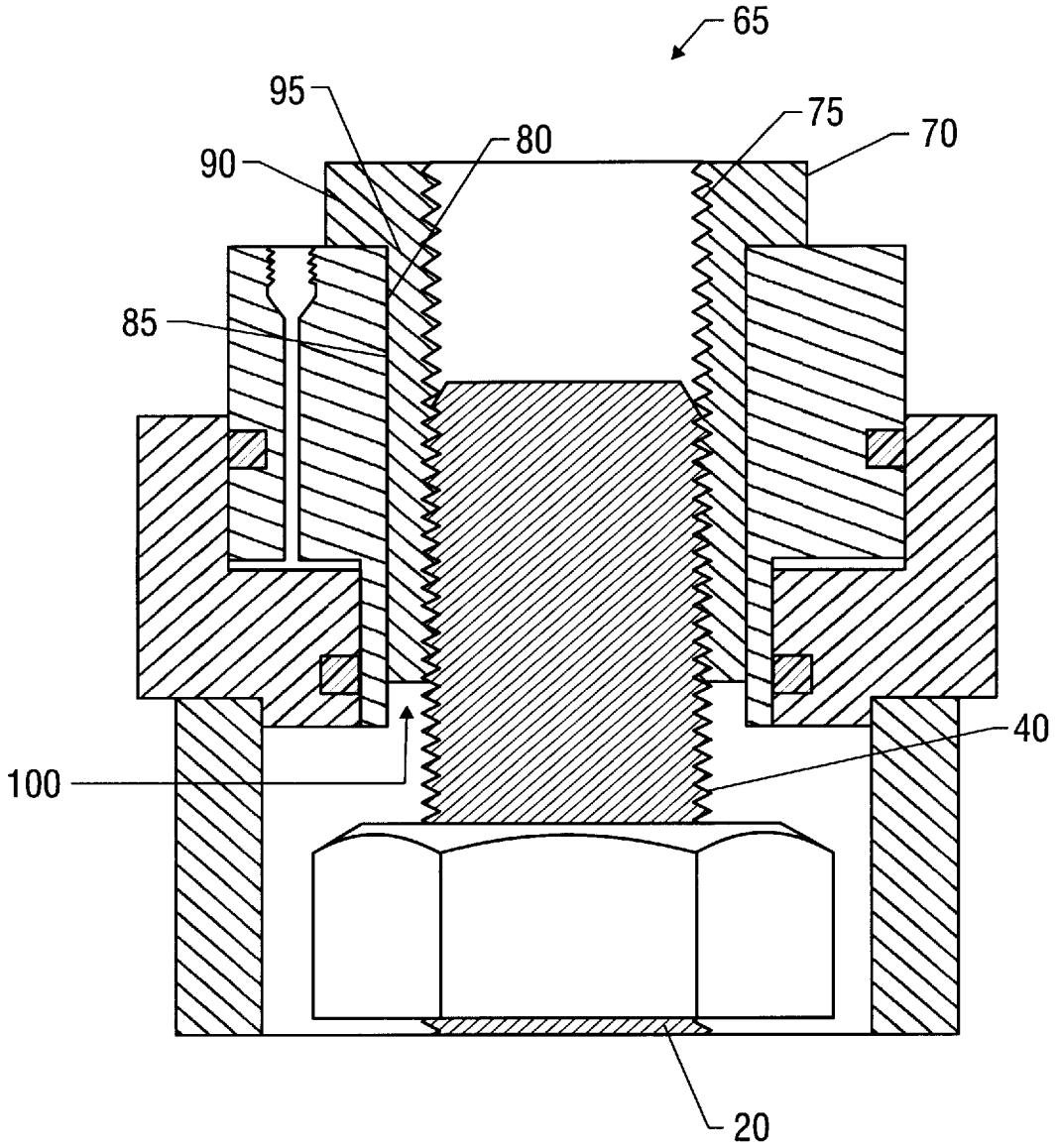
FIG. 1B (prior art)

While the invention is capable of various modifications and alternative forms, a specific embodiment has been shown by way of example in the drawings and will be described herein in detail. This detailed description is not intended to limit the invention or the claims to the particular form described herein.

As used herein, "size" means the nominal diameter, pitch, series, and/or thread form (e.g., UNC, UNF, etc.) of a bolt, nut, or other threaded fastener.

Figure 2:
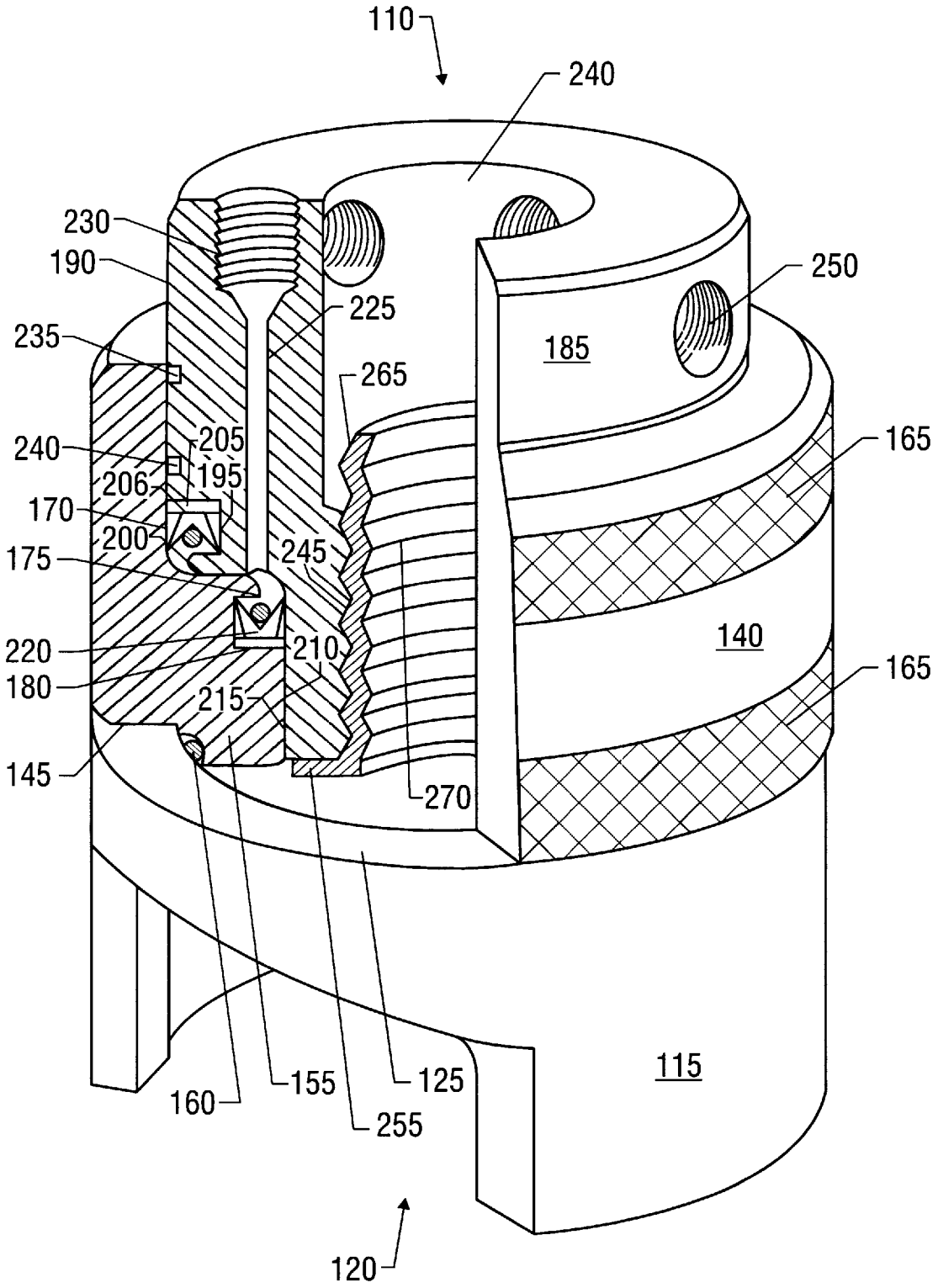
FIG. 2 illustrates a sectional perspective view of a combined hydraulic bolt tensioner and timed adaptor.

Referring to FIG. 2, a bolt tensioner 110 according to the present invention is shown, which comprises a bridge 115, a body 140, and a piston 185. The bridge 115 has an access port 120 and an upper support shoulder 125. The body 140 rests on the bridge 115 such that the lower shoulder 145 of the body 140 rests upon the upper support shoulder 125 of the bridge 115. A snap-ring groove 155 is formed adjacent the bridge/body interface. A snap-ring 160 is adapted to reside in snap-ring groove 155 and removably couples the body 140 to the bridge 115. Knurled surface 165 on the body 140 facilitates rotation of the collar, to assist in threadably engaging the piston to the bolt. The inner wall 170 of the body 140 extends inwardly at a stepped lip 175 and again at an inner ledge 180 to form a seal groove 221 in the body 140.

A piston 185 is insertable within the body 140 such that its outer wall 190 is adjacent the inner wall 170 of the body 140. The outer wall 190 extends inwardly as an upper recessed wall 195. A foot plate 200 protrudes outwardly from the upper recessed wall 195 and rests on the stepped lip 175 of the body 140 to form a piston seal groove 207. A lower recessed wall 210 extends inwardly and downwardly from the foot plate 200 and is positioned adjacent a wall 215 of the body 140. The body seal groove 221 is defined by the interaction of the lower recessed wall 210, the inner ledge 180 and the stepped lip 175.

A pressure conduit 225 provides communication between an external pressure source (not shown) attached to the piston 185 via a threaded pressure coupling 230 and the interface formed between the body 180 and the piston 185, and preferably at the interface of body stepped lip 175 and the piston stepped lip 200. Pressurization of the interface is maintained by seals 206 and 220 positioned between the piston 185 and the body 140 in the seal grooves 221 and 207. In the preferred embodiment, these seals are o-ring energized lip seals, such as the Poly-Pak Seal manufactured by Parker-Hannifin. As shown with seal 206, an anti-extrusion ring 205 may be used, if desired, and also with seal 220.

The piston 185 further includes two indicating rings 235 and 240. The upper ring 235 indicates the bottom of the piston stroke and the lower ring 240 indicates the top of the piston stroke. The indicating rings 235 and 240 can be colored o-rings. The piston also includes a central cavity 240 having a threaded interface 245. Engagement of the threaded interface 245 with a bolt to be tensioned (see e.g., FIG. 6) is facilitated by inserting a tool (not shown) into tool recesses 250 in piston 185 and rotating the piston 185 about the bolt, or merely by rotating the body/piston assembly by hand.

Also shown in FIG. 2 is an adaptor 255 for tensioning bolts of a size different than the size of the threaded interface 245. It will be appreciated that hydraulic tensioner 110 can preload a fastener having a size substantially identical to the size of the threaded interface 245. In addition, and by advantage of the adaptor 255, hydraulic tensioner 110 can also preload fasteners of a size substantially identical to the size of the adaptor 255 and, hence, of a size different than the threaded interface 245.

Figure 3:
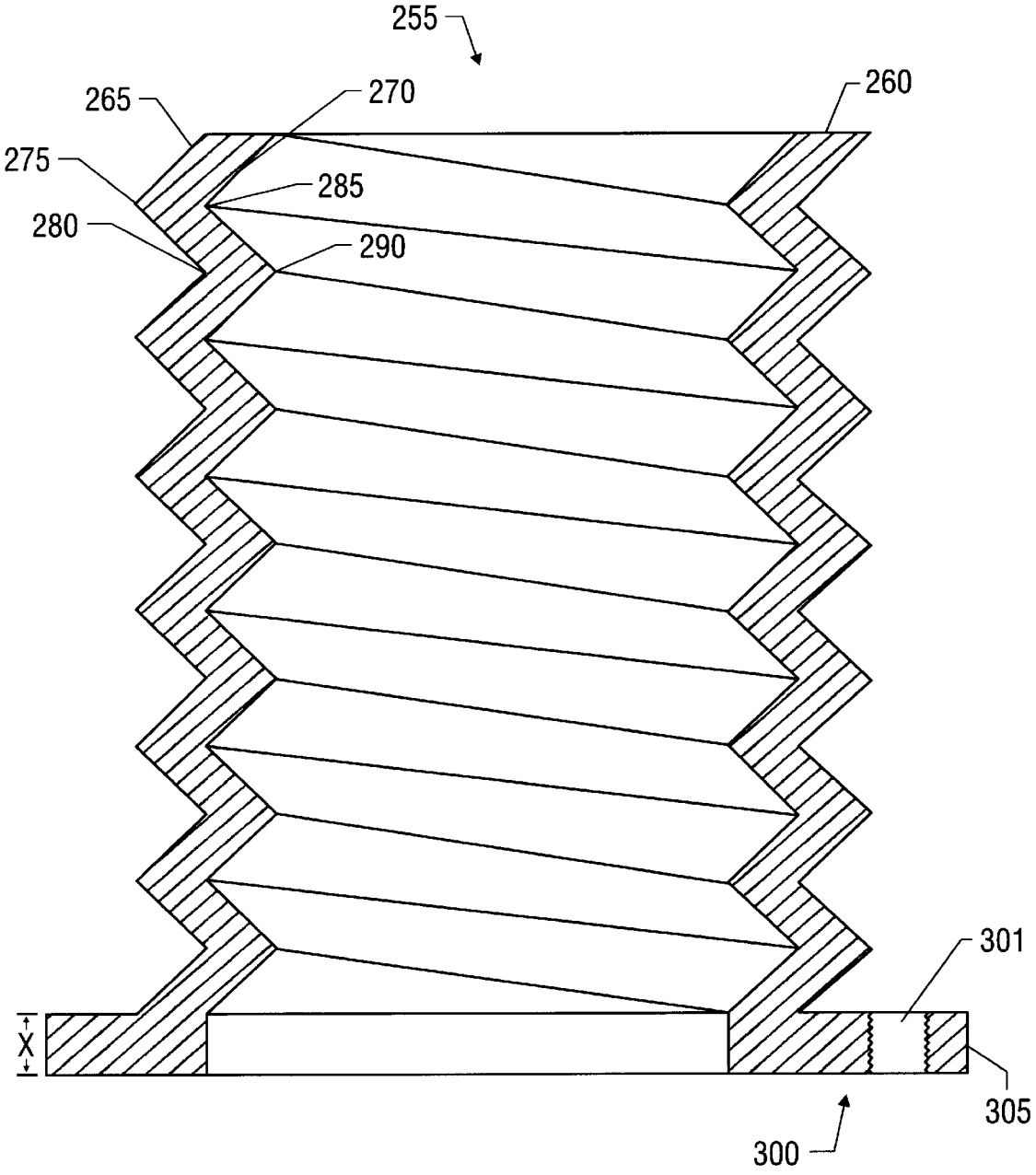
FIG. 3 illustrates a longitudinal sectional view of a timed adaptor.
Figure 4:
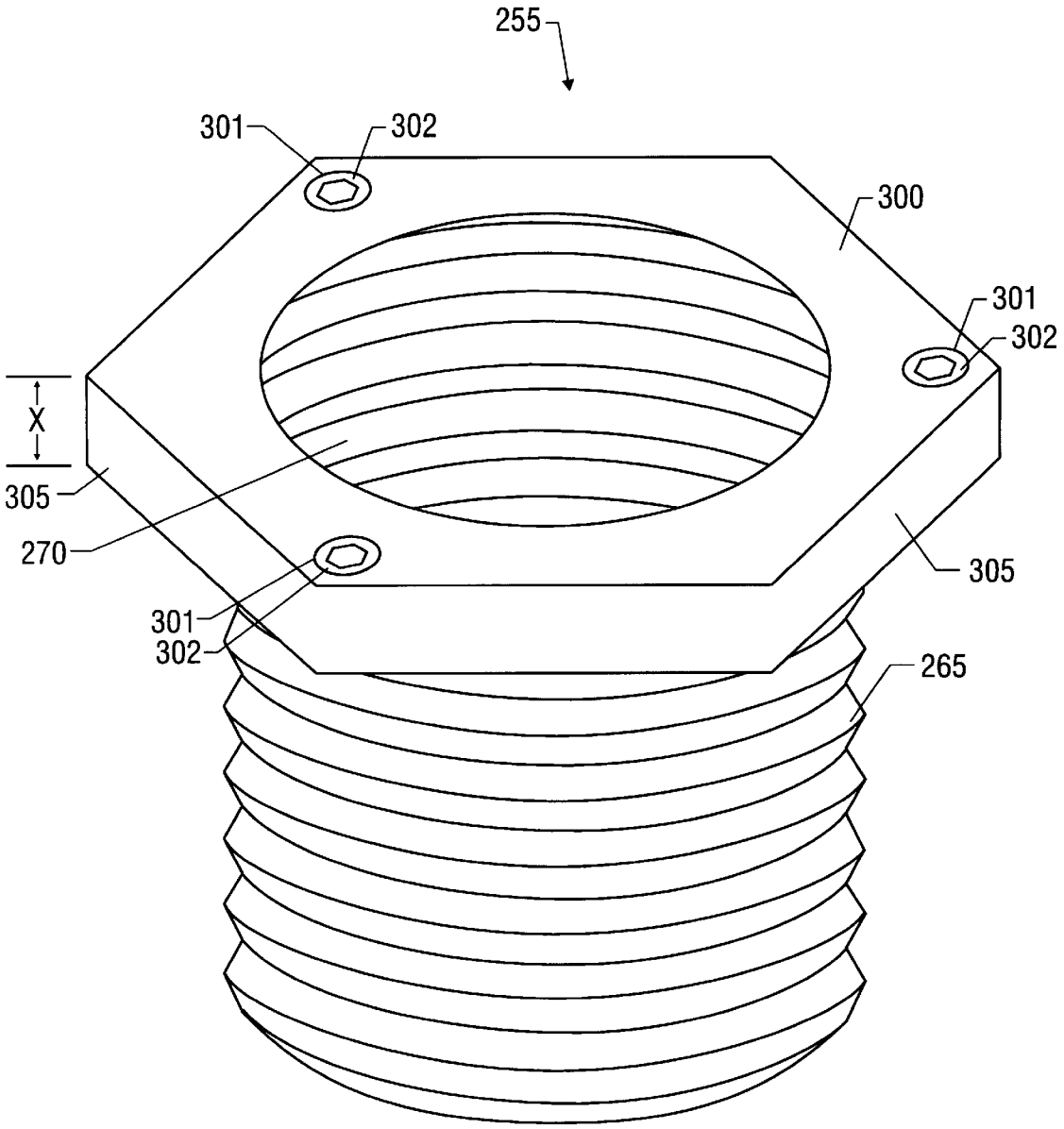
FIG. 4 illustrates a perspective view of a timed adaptor.

Referring to FIG. 3, the adaptor 255 includes a cylindrical portion 260 having a threaded exterior surface 265 and a threaded interior surface 270. The threads of the exterior surface 265 and the interior surface 270 are timed. That is, the positions of the exterior surface major diameter 275 and minor diameter 280 are substantially collinear with the interior surface major diameter 285 and minor diameter 290, respectively. The use of timed threads, as compared to untimed threads, enhances the preloading capacity of the adaptor for any given wall thickness (compare e.g., FIG. 5). The cylindrical wall 260 of the timed adaptor 255 terminates in a head 300 which has a tool surface 305. The tool surface 305 preferably includes wrench lands (shown in FIG. 4). However, other suitable surfaces may be used to facilitate the engagement of the timed adaptor 255 to the piston 185. The adaptor 255 may also have a threaded aperture 301 formed in the tool surface 305. The threaded aperture can accept a set screw 302 or other fastener to lock the adapter 255 to the piston 185 as described below.

Figure 5:
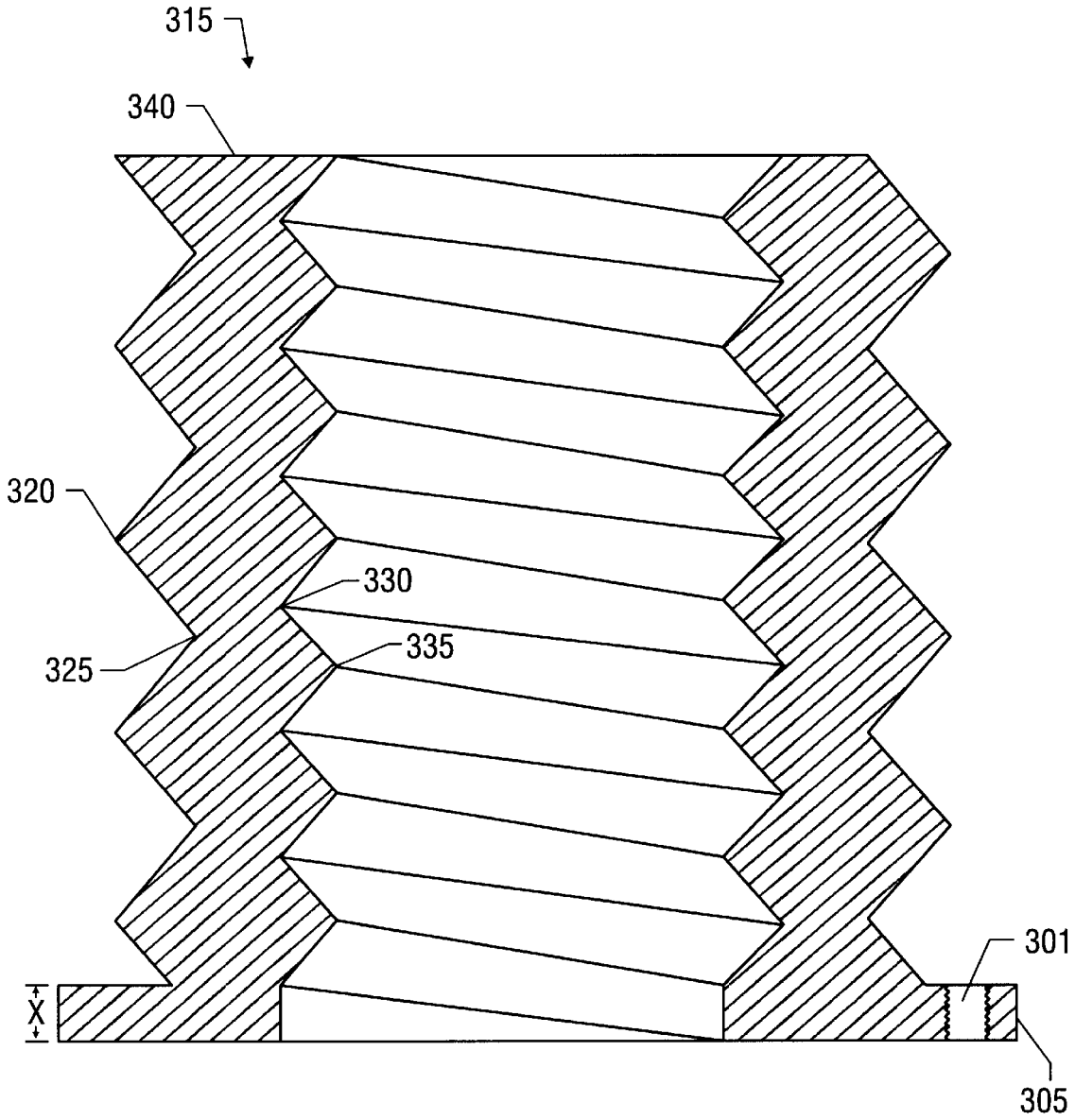
FIG. 5 illustrates a longitudinal sectional view of an untimed adaptor.

FIG. 5 shows an untimed adaptor 315 for use with the bolt tensioner 110 to preload bolts of reduced size. The untimed adaptor 315 functions similarly to the timed adaptor 255 described above. However, the exterior surface major 320 and minor diameters 325 are not substantially collinear with the interior surface major and minor diameters 330, 335, respectively. In addition, for any given tensioning capacity, the cylindrical wall 340 of an untimed adaptor 315 must be thicker than the cylindrical wall 260 of a timed adaptor 255.

The following is an example of using the hydraulic tensioner 110 with timed and untimed adaptors to preload fasteners of different sizes.

If the threaded interface 245 of the hydraulic tensioner 110 is of a size known as 1⅛-8 UNC, the hydraulic tensioner 110 alone can preload fasteners of that size. By using a timed adaptor having external threads of 1⅛-8 UNC and internal threads of 1-8 UNC, the same hydraulic tensioner can preload fasteners of size 1-8 UNC, smaller than the size of the threaded interface 245. Similarly, an untimed adaptor having external threads of size 1⅛-8 UNC and internal threads of size ⅞-10 UNC can be used to preload fasteners of yet smaller size. It will be apparent to those of ordinary skill in the art having benefit of this disclosure that an untimed adaptor having external threads of size 1-8 UNC and internal threads of ⅞-10 UNC likely will not have sufficient wall thickness to preload a fastener to the necessary level. However, an untimed adaptor having external threads of size 1-8 UNC and internal threads of size ¾-10 UNC can be used with another adaptor of size 1⅛-8 UNC by 1-8 UNC to tension a ¾-10 UNC fastener with a hydraulic tensioner having a 1⅛-8 UNC threaded interface.

Figure 6:
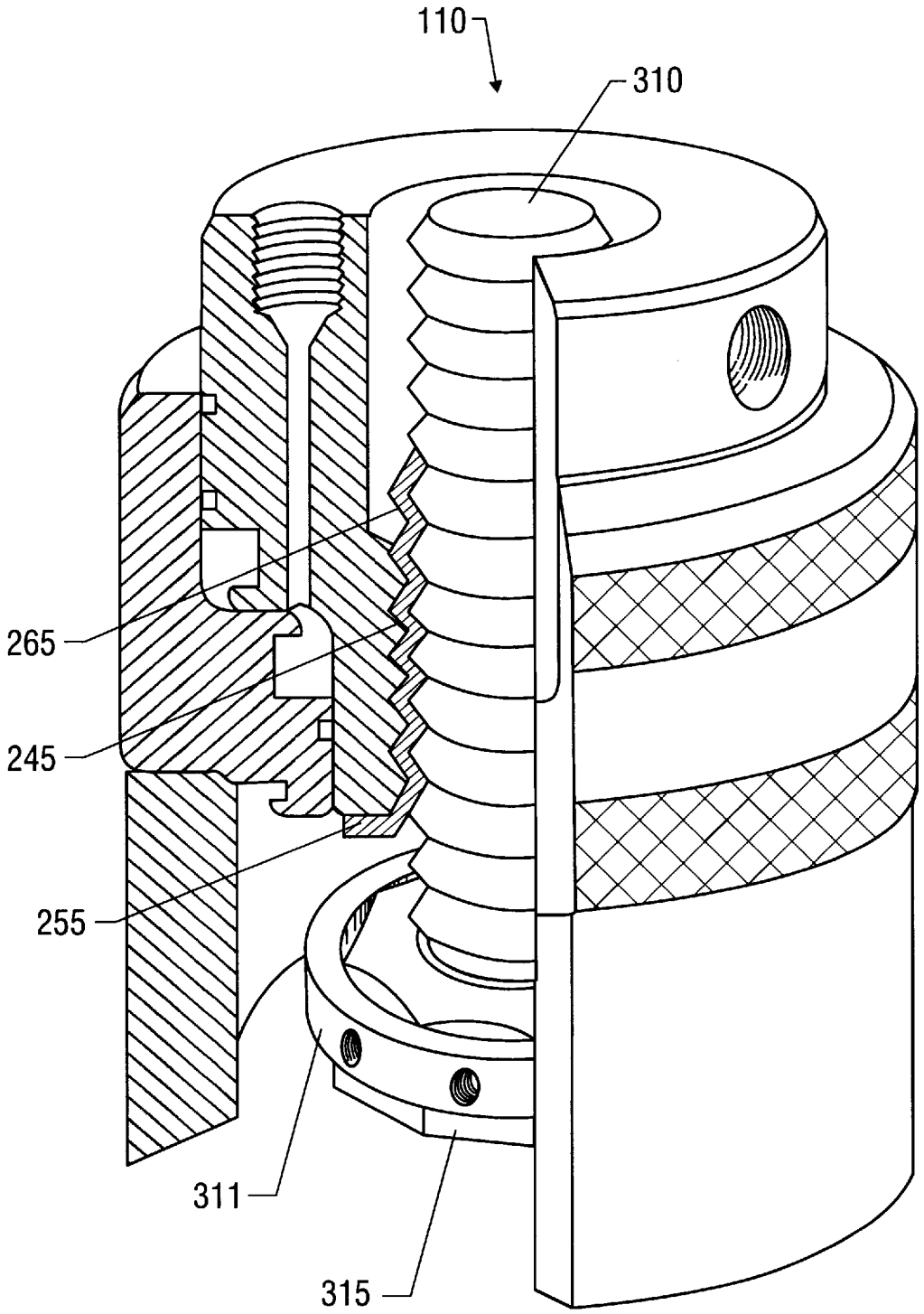
FIG. 6 illustrates a sectional perspective view of a combined hydraulic bolt tensioner and adaptor threadably engaging a bolt.

Referring to FIG. 6, once engaged, the threaded exterior surface 265 of the adaptor 255 is engaged with the threaded bolt interface 245 such that a bolt of reduced size may be tensioned with the bolt tensioner 110. As discussed above, bolts of still smaller size may be tensioned by threadably engaging a second adaptor (not shown) within the first adaptor 255 or 315. In this configuration, the threaded exterior and interior surfaces of the second adaptor engage the threaded interior surfaces 270 of the first timed adaptor 255 or 315 and the threads of the smaller size bolt, respectively.

In operation, a fixed-size bolt tensioner 110 may be adapted with one or more timed or untimed adaptors 255 or 315 in order to tension a reduced size fastener 310. General principles dictate that the length of engagement of the fastener 310 with the adaptor 255 or 315 or with the threaded interface 245 be at least one fastener diameter long. This requirement will help develop the full strength of the threaded engagement for preloading. Also, the thickness "x" of tool surface 305 (see FIGS. 3, 4 and 5) on adaptor 255 or 315 typically should correspond to the amount of diameter reduction in the fastener to be preloaded. For example, when using a 1⅛-8 by 1-8 timed adaptor, the tool surface thickness "x" should be substantially ⅛". Of course, this is because fastener nut height is substantially equal to one fastener diameter. If the fasteners to be preloaded deviate from this general rule, variation in the thickness "x" can be made accordingly. It will be appreciated that for multiple adaptor uses, the cumulative thickness "x" of all adaptors used should equal substantially the overall diameter reduction.

An external pressure source (not shown) is attached to the threaded pressure coupling 230 to pressurize the body/piston assembly. Pressurization displaces the piston 185 away from the body 140, and generates an axial preload on the bolt 310. Once a desired tension or preload has been achieved, a nut 315 may be tightened by hand or with tools via the access port 120. As shown in FIG. 6, a nut spinner 311 can be used with a turning bar (not shown) similar to that used for the piston 185. The bolt tensioner 110 may then be depressurized, and the piston 185 adaptor 255 or 315 assembly disengaged from the bolt 310. Disengagement is facilitated by inserting a tool (not shown) into the tool recess 250 and rotating the combined piston 185/timed adaptor 255 about the bolt 310. Subsequently, the bolt tensioner 110 may be used to tension other bolts of the same size or of a different size as the bolt just tensioned. The set screws 302 (FIG. 4) are provided so that during removal of the piston assembly from the fastener, the adaptor or adaptors will not disengage from the piston and remain on the fastener.

Among the advantages of the invention may be one or more of the following. Adaption of fixed-size bolt tensioners provides a cost savings associated with the reduced expense of purchasing multiple inserts as compared to multiple bolt tensioner units. These costs savings can be enhanced by the use of multiple inserts with a single fixed-size bolt tensioner. Because adapters may be inserted with the use of simple hand tools, fixed-size bolt tensioners may be easily adapted to tension bolts of varying size. The threaded engagement of the adaptor and the bolt tensioner provides a safety feature in that it prevents the release of a high velocity projectile in the event of bolt or thread failure during tensioning.

Figure 7:
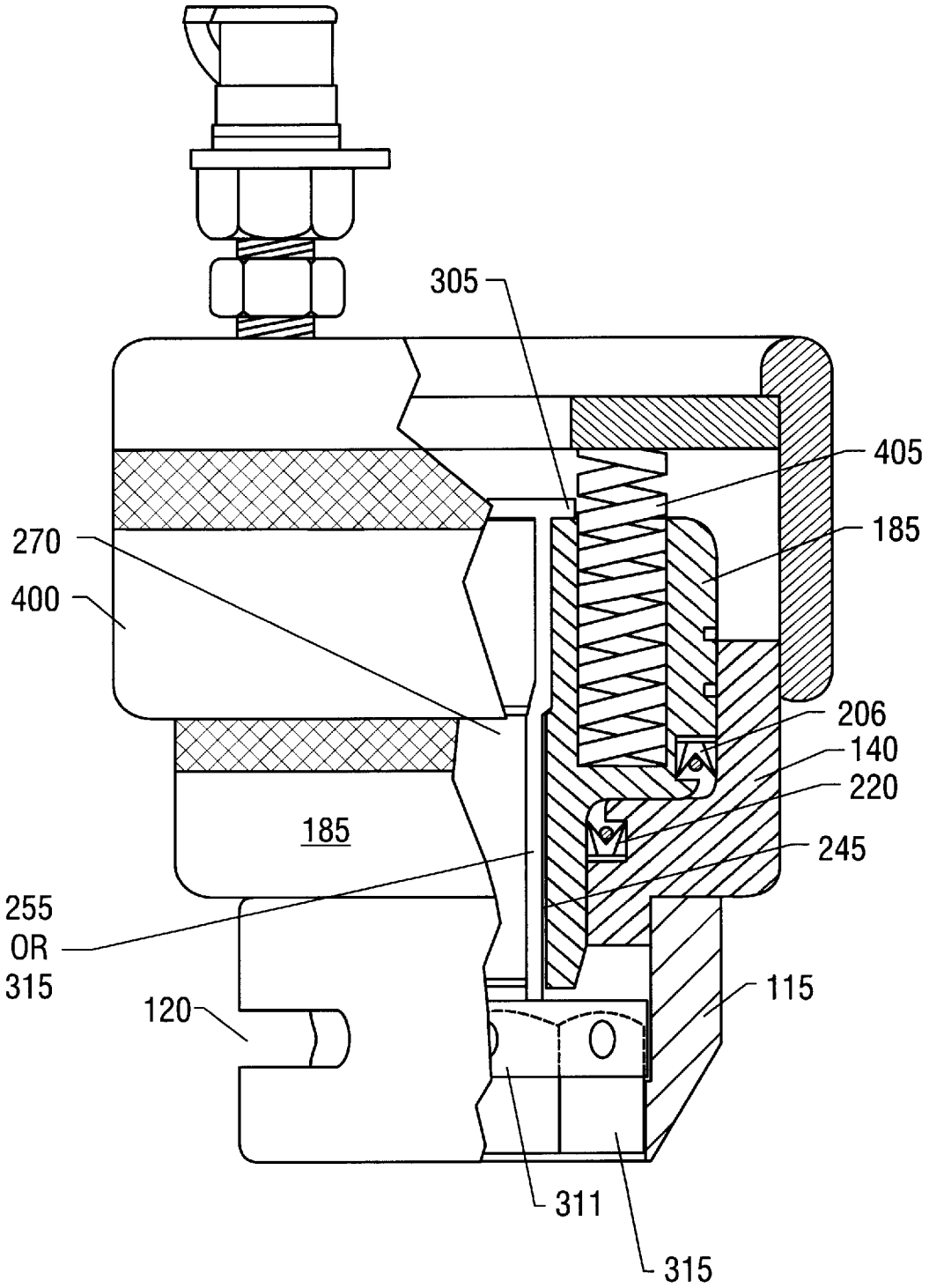
FIG. 7 illustrates an automatic return hydraulic tensioner.

Although the embodiment described herein uses adaptors that engage the piston 185 from below (that is, adjacent the bridge), the present invention also contemplates adaptors that engage the piston from above as shown in FIG. 7. Also shown in FIG. 7, the present invention can be used with an automatic return feature. In FIG. 7, a retaining collar 400 allows return springs 405 to force piston 185 to the bottom of its stroke after hydraulic pressure has been removed. Other modifications and variations are within the scope of the following claims.

What is claimed is:

1. A bolt tensioner, comprising:

a body and a piston, the body and piston moveable relative to one another in response to a force supplied therebetween, the piston having a threaded receptacle of a first pitch for engaging a first size bolt;

an adaptor having external threads of said first pitch, and internal threads having a pitch selected from the group consisting of a pitch not timed with the external threads and a pitch timed with the external threads; and a bridge upon which the body reacts, and which provides an opening for tightening the bolt during tensioning.

2. A fastener tensioner, comprising:

a body and a piston, the body and piston moveable relative to one another in response to a force supplied therebetween, the piston having a threaded receptacle for engaging a first size fastener;

an adaptor having internal threads for engaging a second size fastener, the adaptor having external threads for engaging the threaded receptacle; and a second adaptor having internal threads for engaging a third size fastener, the second adaptor having external threads for engaging the internal threads of the first adaptor.

3. The bolt tensioner of claim 1, wherein the adaptor further comprises:

an attaching surface for engaging and disengaging the adaptor and the bolt tensioner.

4. The bolt tensioner of claim 1, wherein the force comprises hydraulic pressure.

5. A threaded fastener tensioner, comprising:

a body having a bridge with an opening to a threaded fastener, a piston, the body and piston moveable relative to one another in response to a force supplied therebetween, the piston having a threaded receptacle for engaging a first size fastener; and an adaptor having internal threads for engaging a second size fastener, the adaptor having external threads for engaging the threaded receptacle.

6. The bolt tensioner of claim 3, wherein the attaching surface comprises wrench lands, wherein a thickness of the wrench lands is substantially equal to the amount of bolt diameter reduction provided by the adaptor.

7. The bolt tensioner of claim 1, further comprising a retainer for removably coupling the bridge to the body.

8. The bolt tensioner of claim 1, further comprising an indicator for showing a position of the piston relative to the body.

9. The bolt tensioner of claim 4, wherein said hydraulic pressure is conducted through the piston to react against the body.

10. The bolt tensioner of claim 1, further comprising an automatic piston return member for biasing the piston to its non-tensioning position when the force is removed.

11. The fastener tensioner of claim 2, further comprising a position indicator for showing the relative position of the piston.

12. The fastener tensioner of claim 2, further comprising a bridge removably coupled to the body, and which provides access to the fastener.

13. The fastener tensioner of claim 10, wherein the bridge is removably coupled to the body with a snap ring.

14. The fastener tensioner of claim 10, wherein the piston has a first position relative to the body when no force is supplied and a second position relative to the body when the fastener is tensioned, and further comprising a member for returning the piston to the first position when the force is removed.

15. The fastener tensioner of claim 2, wherein the first adaptor is removably locked to the piston.

16. The fastener tensioner of claim 15, wherein the second adaptor is removably locked to the first adaptor.

17. The threaded fastener tensioner of claim 5, further comprising a position indicator for showing the position of the piston relative to the body.

18. The threaded fastener tensioner of claim 5, wherein the bridge is coupled to the body by a removable member.

19. The threaded fastener tensioner of claim 18, wherein the member is a snap ring.

20. A size adaptable bolt tensioner, comprising a body having an interior aperture adapted to receive a first bolt of a predetermined size, the interior also having an internal shoulder;

a piston adapted to reside in the body aperture adjacent the internal shoulder, the piston having internal threads for mating with the first bolt, the piston and body being in substantially fluid tight engagement;

a conduit for supplying pressure between the piston and the body adjacent the internal shoulder;

an adaptor having external threads of a first pitch, and internal threads having a pitch selected from the group consisting of a pitch not timed with the external threads and a pitch timed with the external threads; and a bridge upon which the body reacts, and which provides access to the tensioned bolt.

21. The tensioner of claim 20, wherein the bridge is removably coupled to the body.

22. The tensioner of claim 20, further comprising an indicator for showing a position of the piston relative to the body.

23. The tensioner of claim 19, wherein said conduit is located in the piston.

24. The tensioner of claim 19, further comprising an automatic piston return member for biasing the piston to its non-tensioning position when the force is removed.

25. The tensioner of claim 24, wherein the automatic piston return member comprises a collar adjacent the piston and which is coupled to the body and a spring positioned between the collar and the piston.

26. The bolt tensioner of claim 1, wherein the pitch of the internal threads is the first pitch.

27. The threaded fastener tensioner of claim 5, wherein the piston has a first position relative to the body when no force is supplied and a second position relative to the body when the fastener is tensioned, and further comprising a collar member adjacent the piston for returning the piston to the first position when the force is removed.

* * * * *

UNITED STATES PATENT AND TRADEMARK OFFICE

CERTIFICATE OF CORRECTION

PATENT NO. : 5,871,205

DATED : February 16, 1999

INVENTOR(S) : Robert J. Latham

It is certified that error appears in the above-identified patent and that said Letters Patent is hereby corrected as shown below:

In column 7, line 22, after the word "claim," please delete "10" and insert --12-- therefor.

In column 7, line 24, after the word "claim," please delete "10" and insert --12-- therefor.

In column 8, line 23, after the word "claim," please delete "19" and insert --20-- therefor.

In column 8, line 25, after the word "claim," please delete "19" and insert --20-- therefor.

Signed and Sealed this

Seventeenth Day of August, 1999

*Attest:*

Q. TODD DICKINSON

*Attesting Officer*

*Acting Commissioner of Patents and Trademarks*